United States Patent [19]

Fushida et al.

[11] Patent Number: 4,652,510

[45] Date of Patent: Mar. 24, 1987

[54] METHOD FOR FORMING NEGATIVE AND POSITIVE IMAGES IN ELECTROPHOTOGRAPHIC PROCESS

[75] Inventors: Akira Fushida, Suita; Toshikazu Matsui, Kishiwada; Yuuji Hasegawa, Nishinomiya; Masahiko Maeda, Izumiotsu; Nobuyuki Tsuji, Kakogawa; Akira Horiuchi, Osaka; Kazunori Yukitake, Sakai, all of Japan

[73] Assignee: Mita Industrial Co., Ltd., Osaka, Japan

[21] Appl. No.: 771,416

[22] Filed: Aug. 30, 1985

[30] Foreign Application Priority Data

Aug. 31, 1984 [JP] Japan ..... 59-180381

[51] Int. Cl.[4] ..... G03G 9/14

[52] U.S. Cl. ..... 430/122; 430/106.6

[58] Field of Search ..... 430/97, 110, 103, 106.6, 430/122

[56] References Cited

U.S. PATENT DOCUMENTS

| | | | |
|---|---|---|---|
| 4,342,822 | 8/1982 | Hosono et al. | 430/122 |
| 4,350,749 | 9/1982 | Ohnuma et al. | 430/122 |
| 4,395,476 | 7/1983 | Kanbe et al. | 430/122 |
| 4,430,411 | 2/1984 | Tamura et al. | 430/122 |
| 4,487,825 | 12/1984 | Gruber et al. | 430/106.6 |

*Primary Examiner*—John L. Goodrow

*Attorney, Agent, or Firm*—Sherman and Shalloway

[57] ABSTRACT

Disclosed is an electrophotographic process which comprises developing an electrophotographic light-sensitive layer having an electrostatic charge image of a certain polarity with a one-component type magnetic developer where positive and negative frictional charge polarities are mingled, under development bias voltage conditions capable of developing the electrostatic charge image, the background or both, and bringing the light-sensitive layer having a developer layer formed thereon into contact with a transfer sheet under a transfer charge of the same polarity as that of the electrostatic charge image when a positive image is formed or under a transfer charge of a polarity reverse to that of the electrostatic charge image when a negative image is formed, to form an image on the transfer sheet.

6 Claims, 5 Drawing Figures

METHOD FOR FORMING NEGATIVE AND POSITIVE IMAGES IN ELECTROPHOTOGRAPHIC PROCESS

BACKGROUND OF THE INVENTION (1) Field of the Invention

The present invention relates to a method for forming negative and positive images in the electrophotographic process. More particularly, the invention relates to an electrophotographic process in which either negative images or positive images can be formed only by electric controls by using an ordinary electrophotographic light-sensitive layer and a single one-component type magnetic developer.

(2) Description of the Prior Art

In the field of the electrophotography, there is a strong desire for a multiple-objective copying system in which not only ordinary reproduction for forming a positive copy from a positive original but also formation of a reversed positive image from a negative original such as a microfilm or from a negative electrostatic latent image such as a laser beam or light emitting diode array is possible.

Conventional negative/positive reproduction systems are roughly divided into two types. According to one type of the conventional method, a bichargeable photosensitive material and a toner having a tendency to be frictionally charged with a certain polarity are used, when a positive image is obtained, the polarity of the charge of the photosensitive layer is made opposite to the charge polarity of the toner, and when a negative image is formed, the polarity of the photosensitive material is made the same as that of the toner and a reversed image is formed. However, the number of bichargeable photosensitive materials is considerably limited and hence, the durability and sensitivity are restricted. Furthermore, the sensitivity and other electrophotographic characteristics of the photosensitive material greatly differ between the case of positive charging and the case of negative charging, and it is very difficult to adjust the densities and qualities of negative and positive images to substantially equal levels.

According to another type of the conventional method, a photosensitive material which is chargeable with a certain polarity is used, an electrostatic latent image is formed by charging and imagewise light exposure, when a positive image is formed, development is carried out by using a toner charged with a polarity reverse to the polarity of the electrostatic latent image, and when a negative image is formed, reversal development is carried out by using a toner having the same polarity as that of the electrostatic latent image. This method is defective in that two kinds of toners should be prepared and the toner-exchanging operation is troublesome.

SUMMARY OF THE INVENTION

It is therefore a primary object of the present invention to provide an electrophotographic process in which negative images and positive images can be optionally formed only by electric controls by using an ordinary photosensitive material and a single developer.

Another object of the present invention is to provide an electrophotographic process in which not only a positive image-forming capacity but also a negative image-forming capacity is given to a conventional electrophotographic copying machine by selecting a developer and building an electric control circuit in the copying machine.

More specifically, in accordance with the present invention, there is provided an electrophotographic process which comprises developing an electrophotographic light-sensitive layer having an electrostatic charge image of a certain polarity with a one-component type magnetic developer where positive and negative frictional charge polarities are mingled, under development bias voltage conditions capable of developing the electrostatic charge image, the background or both, and bringing the light-sensitive layer having a developer layer formed thereon into contact with a transfer sheet under a transfer charge of the same polarity as that of the electrostatic charge image when a positive image is formed or under a transfer charge of a polarity reverse to that of the electrostatic charge image when a negative image is formed, to form an image on the transfer sheet.

DETAILED DESCRIPTION OF THE PREFERRED EMBODIMENTS

The present invention will now be described in detail with reference to preferred embodiments illustrated in the accompanying drawings.

According to the present invention, a one-component type magnetic developer in which positive and negative frictional charge polarities are mingled, that is, a one-component type magnetic developer capable of developing either a positive charge image or a negative charge image, is used, and by selecting the development bias voltage condition and changing over the polarity of transfer charging, negative or positive images having substantially constant density and image quality can be easily formed.

PRINCIPLE OF ELECTROPHOTOGRAPHIC PROCESS

The principle of electrophotographic process of the present invention is the same as that of the known Carlson process except the above-mentioned characteristic features. The principle of the electrophotographic process of the present invention will now be described with reference to FIG. 1 and FIGS. 2-A, 2-B and 2-C.

Figure 1:
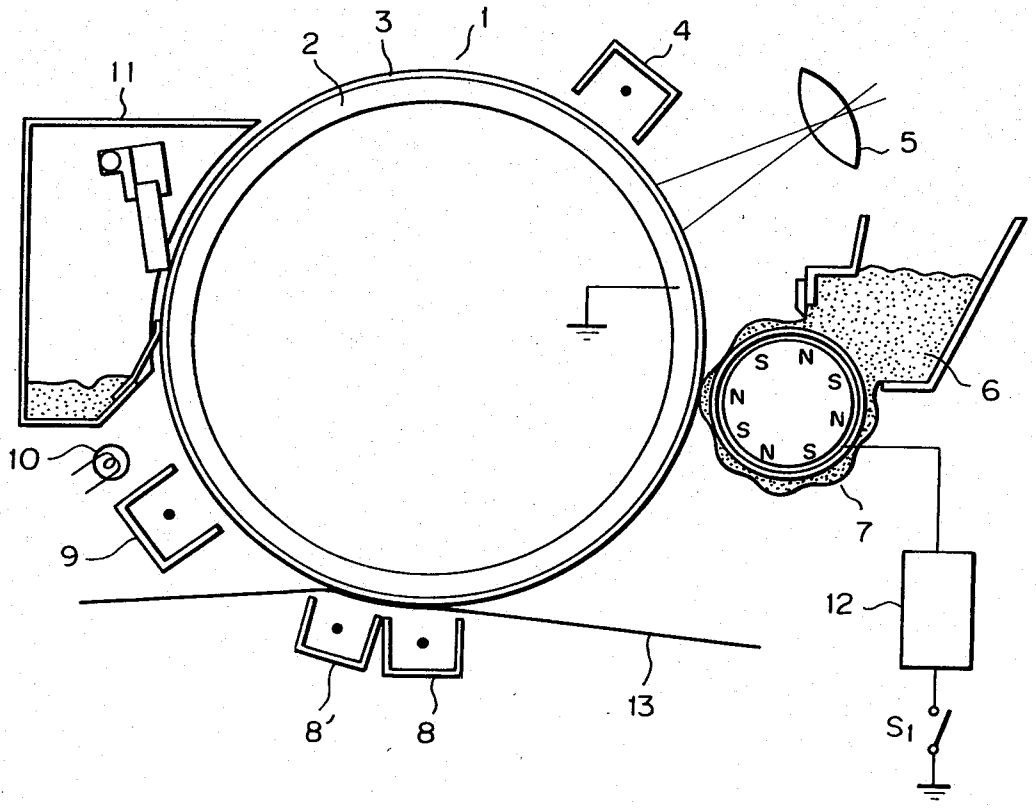
FIGS. 1 through 3 are diagrams illustrating the reproduction process according to the present invention.

Referring to FIG. 1, a photoconductive light-sensitive layer 3 is formed on the surface of an electrically conductive substrate 2 of a driving rotary drum 1. A direct current corona charger 4 for main charging, an optical system 5 for imagewise light exposure, a developing mechanism 7 for holding therein a one-component type magnetic developer 6 described hereinafter, transfer corona chargers 8 and 8', an electricity-removing direct current corona charger 9 of a polarity opposite to the polarity of main charging, a light source 10 for removal of the electricity and a toner cleaning mechanism 11 are arranged along the surface of the drum 1 in the recited order.

At the start of copying, the electricity-removing charger 9, the light source 10 for removal of the electricity and the cleaning mechanism 11 are actuated to remove dusts, soils and the like adhering to the surface of the light-sensitive layer 3.

Then, the light-sensitive layer 3 is charged with charges of a certain polarity by the corona charger 4 for main charging, and imagewise light exposure is carried out through the optical system 5 to form an electrostatic image corresponding to the original image.

The one-component type magnetic developer 6 is a developer in which negative and positive frictional charge polarities are mingled. A bias voltage applying apparatus 12, if necessary provided with a switch S1 for controlling the development mode, is arranged between the light-sensitive layer 3 and the developing mechanism 7. Development of the charge image on the light-sensitive layer 3 is effected with the one-component type developer 6 according to modes shown in FIGS. 2-A, 2-B and 2-C.

Figure 3:
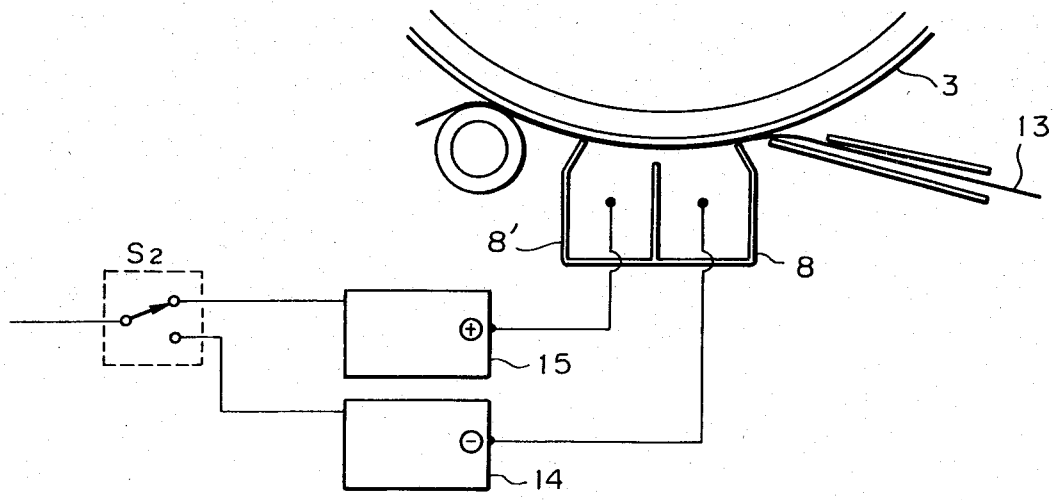

Finally, as shown in FIG. 3, a copy sheet 13 is supplied to the surface of the light-sensitive layer 3 carrying a developer layer thereon and charging is performed from the back surface of the copy sheet 13 by the transfer corona charger 8 or 8' to transfer the developer layer to the surface of the copy sheet 13. The two transfer chargers 8 and 8' correspond to two transfer modes, and a power source 14 for negative corona charging is connected to the charger 8 and a power source 15 for positive corona charging is connected to the charger 8'. Changeover is effected between the power sources 14 and 15 by a switch S2. It is preferred that this transfer mode changeover switch S2 be arranged so that it operates with the development mode changeover switch S1.

Figure 2:
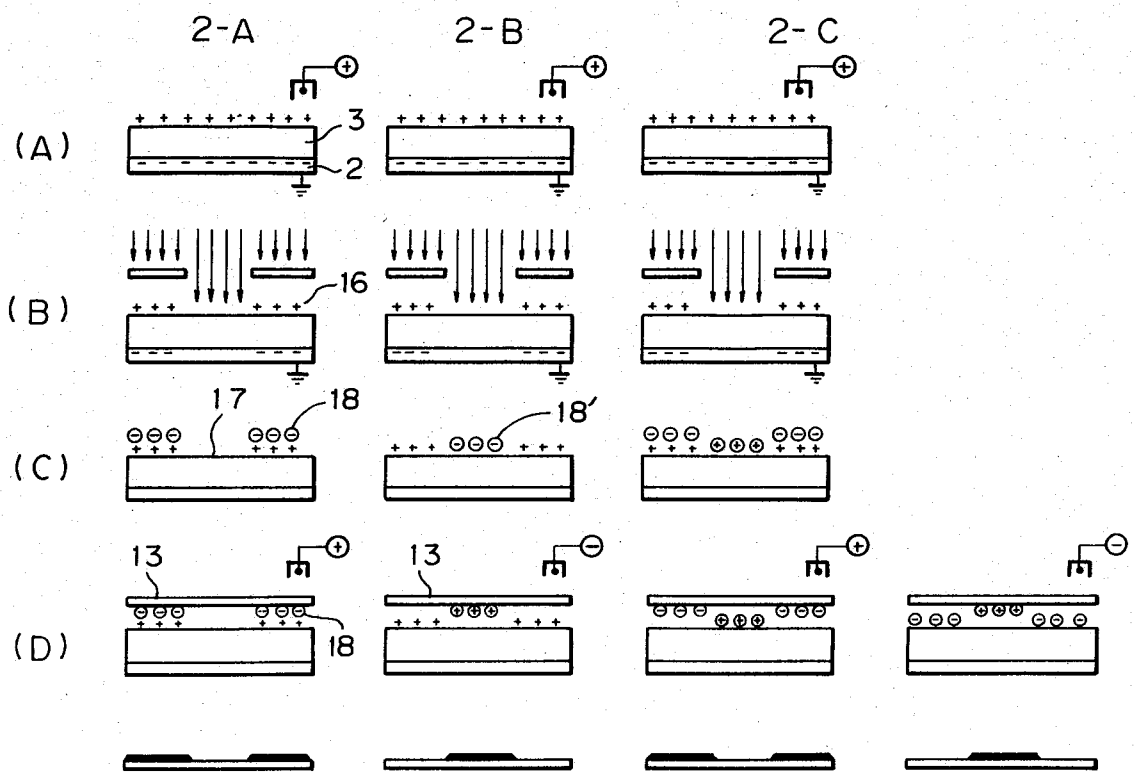

Referring to FIG. 2-A illustrating ordinary copying, that is, the positive/positive reproduction mode, at the charging step (A) the surface of the light-sensitive layer 3 is positively charged uniformly, and at the subsequent imagewise light exposure step (B) a positive charge image 16 corresponding to the dark portion is formed. Then, at the development step (C) development is performed on the surface of the light-sensitive layer 3 by using the above-mentioned one-component type magnetic developer. Since the background is not charged, if the applied bias voltage is zero or low, only the portion of the positive charge image is developed with negatively charged particles of the developer to form a developer image 18. At the transfer step (D) a positive charge is applied from the back surface of the transfer sheet 13, whereby the developer image 18 is transferred and adheres to the surface of the transfer sheet. At the subsequent fixing step (E) the developer image is fixed to the transfer sheet.

Referring to FIG. 2-B illustrating reversal copying, that is, the positive/negative copying or negative/positive copying mode, the charging step (A) and imagewise light exposure step (B) are the same as in FIG. 2-A, and at the development step (C), the same one-component type magnetic developer as in FIG. 2-A is used but a positive bias voltage sufficient to overcome the positive charge image 16 on the surface of the light-sensitive layer 3 is applied to the surface of the light-sensitive layer 3. As the result, the background 17 is developed with positively charged particles to form a developer image 18'. At the transfer step (D) a negative charge is applied from the back surface of a transfer sheet, whereby a reversed image is formed on the transfer sheet 13 in contrast to the mode shown in FIG. 2-A.

Referring to FIG. 2-C illustrating another copying mode according to the present invention, either a normal image or a reverse image can be optionally obtained in one development mode by adjusting the bias voltage at the time of development, and in this case, the charging step and imagewise light exposure step are the same as in FIGS. 2-A and 2-B and the same developer is used but at the development step (C) a positive bias voltage, which is substantially intermediate between the voltages applied in the modes shown in FIGS. 2-A and 2-B, is applied. Namely, the development is performed so that both the charge image portion 16 and the background portion 17 are formed into solid black portions. At the subsequent step, if positive transfer charging is carried out as in the mode of FIG. 2-A, a normal transferred image is obtained and if negative transfer charging is carried out as in the mode of FIG. 2-B, a reversed transfer image is obtained.

Figure 4:
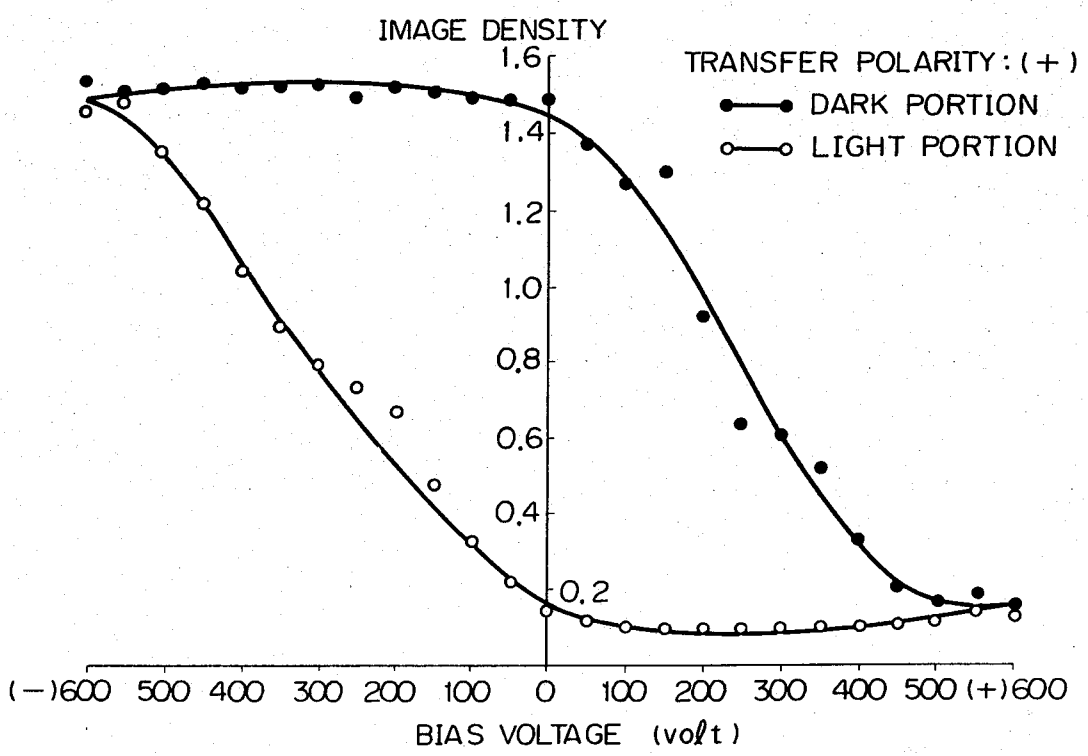
FIGS. 4 and 5 are diagrams illustrating experimental results obtained in the present invention.
Figure 5:
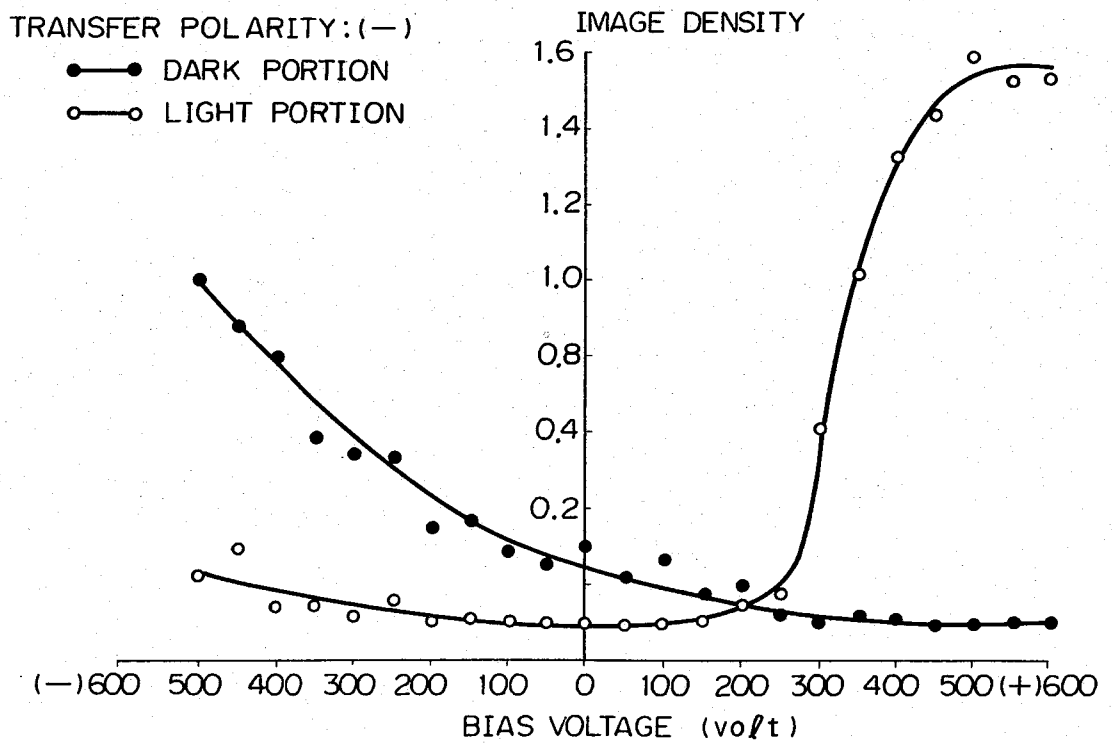

According to the present invention, copying operations of the above-mentioned three modes can be optionally performed by using a one-component type magnetic developer having both the positive and negative charge polarities and appropriately selecting the development bias voltage and the transfer charge polarity. This will be readily understood from the experimental results shown in FIGS. 4 and 5. In these Figures, with respect to light portions (background indicated by mark "") of the light-sensitive layer and dark portions (charge image portions indicated by mark " "), the bias voltage is plotted on the abscissa and the image density is plotted on the ordinate. FIG. 4 shows results obtained when positive transfer charging is effected on the positively charged light-sensitive layer and FIG. 5 shows results obtained when negative transfer charging is effected on the positively charged light-sensitive layer. From these results, it is seen that in the region where the bias voltage is low (FIG. 4), the transfer image density of the positive image is highest while the transfer image density of the negative image is controlled to a lowest level, in the region of FIG. 5 where the bias voltage is high and the transfer image density of the positive image is controlled to a lowest level, the transfer image density of the negative image is highest, and in the region of an intermediate bias voltage (about 300 V), both the charge image portion and the background portion are developed and either a positive image or a negative image can be optionally obtained by appropriately selecting the polarity of transfer charging.

DEVELOPER

The one-component type magnetic developer used in the present invention is prepared by dispersing a powder of a magnetic material in an electrically insulating resin binder and pulverizing the resulting kneaded composition, if necessary followed by sieving, to form particles having a particle size of 5 to 30 μm. This one-component type magnetic developer has such characteristic properties that the magnetic developer can form a stable magnetic brush thereof on the surface of a sleeve composed of a non-magnetic material, which has magnets arranged therein, and the developer per se is charged by friction. The degree of charging by friction among the surfaces of particles depends on the frictional electrification row of the surfaces, and when one surface is negatively charged, the other surface is positively charged. This includes the case where the charge polarity differs among individual particles and the case where the charge polarity differs microscopically in one particle among parts of the surface thereof.

As the powder of the magnetic material for the developer, there can be used powders of triiron tetroxide ($Fe_3O_4$), diiron trioxide ($\gamma$-$Fe_2O_3$) zinc iron oxide ($ZnFe_2O_4$), yttrium iron oxide ($Y_3Fe_5O_{12}$), cadmium iron oxide ($CdFe_2O_4$) gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NbFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$), and iron powder (Fe), cobalt powder (Co) and nickel powder (Ni). Among them, triiron tetroxide (magnetite) is especially preferred. It is preferred that the particle size of the magnetic material be 0.05 to 5 $\mu$m.

Any of electrically insulating resins can be used as the binder, and thermoplastic resins and uncured products and precondensates of thermosetting resins can be used. Valuable natural resins are a balsam, rosin, shellac and copal, and they may be modified with at least one of vinyl resins, acrylic resins, alkyd resins, phenolic resins, epoxy resins and oleoresins described hereinafter. As the synthetic resin, there can be mentioned vinyl resins such as vinyl chloride resins, vinyldiene chloride resins, vinyl acetate resins, vinyl acetal resins, e.g., polyvinyl butyral, and vinyl ether polymers, acrylic resins such as polyacrylic acid esters, polymethacrylic acid esters, acrylic acid copolymers and methacrylic acid copolymers, olefin resins such as polyethylene and polypropylene, styrene type resins such as polystyrene, hydrogenated styrene resins, polyvinyl toluene and styrene copolymers, polyamide resins such as nylon 12, nylon 6 and polymerized fatty acid-modified polyamides, polyesters such as polyethylene terephthalate/isophthalate and polytetramethylene terephthalate/isophthalate, alkyd resins such as phthalic acid resins and maleic acid resins, phenol-formaldehyde resins, ketone resins, coumarone-indene resins, terpene resins, amino resins such as urea-formaldehyde resins and melamine-formaldehyde resins, and epoxy resins. A mixture of two or more of these synthetic resins, for example, a mixture of a phenolic resin and an epoxy resin and a mixture of an amino resin and an epoxy resin, may be used.

In view of the bichargeability, the magnetic brush-forming property and the fixing property, it is preferred that the weight ratio of the powder of the magnetic material to the electrically insulating binder resin be in the range of from 40/100 to 75/100, especially from 50/100 to 60/100. Of course, known additives such as a coloring pigment, a conducting agent, an offset preventing agent, a charge controlling agent and a flowability improver may be added to the developer according to the known recipes.

Granulation may be easily accomplished by melt-kneading the above-mentioned components, cooling the kneaded mixture and pulverizing it. Moreover, the granular product may be obtained by dispersing the powder of the magnetic material in a solution of the resin and subjecting the dispersion to spray granulation. The shape of the particles is not particularly critical. Namely, the particles may have a spherical shape, an indeterminate shape or an indeterminate shape having corners slightly rounded.

OTHER CONDITIONS

The present invention can be applied to a known electrophotographic light-sensitive material. The kind of the light-sensitive layer is not particularly critical. That is, any of positively chargeable light-sensitive material, a negatively chargeable light-sensitive material and a bichargeable light-sensitive material can be used. As preferred examples of the light-sensitive layer, there can be mentioned inorganic photoconductor light-sensitive layer such as an amorphous selenium light-sensitive layer, an amorphous silicon light-sensitive layer, a zinc oxide/binder resin light-sensitive layer and a CdS/resin binder light-sensitive layer, and organic photoconductor light-sensitive layers such as an organic pigment/resin binder light-sensitive layer, an organic pigment charge-generating phase/charge transfer phase dispersion type light-sensitive layer and an organic pigment charge-generating phase/charge transfer phase laminate type light-sensitive layer. Of course, light-sensitive layers that can be used in the present invention are not limited to those exemplified above.

It is preferred that in the case where a reversed image is formed, the bias voltage be about 40 to about 150% of the set surface voltage Vo of the light-sensitive layer in the same direction (with the same polarity). On the other hand, in the case where a normal image is formed, it is preferred that the bias voltage be within 30% of the surface voltage in the same direction.

As is apparent from the foregoing description, according to the present invention, either a normal image or a reversed image can be optionally obtained very easily by using a single one-component type magnetic developer without any particular limitation being imposed on the electrophotographic light-sensitive layer to be used. Furthermore, this image formation can be accomplished only by electric controls such as adjustment of the bias voltage and changeover of the polarity of transfer charging and such troublesome operations as exchange of toners are not necessary at all. Moreover, whether normal images or reversed images are formed, the charging and imagewise light exposure steps are the same and the same developer is used, and the formed transfer images are substantially the same in the image density and quality. These are prominent characteristics of the present invention over the conventional processes.

Still further, the process of the present invention is practically advantageous in that if slight modifications are made of conventional copying machines, multiple-object reproduction becomes possible.

The present invention will now be described in detail with reference to the following examples that by no means limit the scope of the invention.

PREPARATION OF LIGHT-SENSITIVE MATERIAL

| | |
|---|---|
| N,N'—Di(3,5-dimethylphenyl)-perylene-3,4,9,10-tetracarboxylic acid diimide | 12 parts by weight |
| Poly-N—vinylcarbazole | 100 parts by weight |
| Polyester resin (Byron 200 supplied Toyobo K.K.) | 10 parts by weight |
| Tetrahydrofuran | 150 parts by weight |

The above components were mixed and the liquid mixture was dispersed in a ball mill for 24 hours. The liquid composition was coated on a cylindrical drum of aluminum having a thickness of 1.5 mm according to the dip coating method, and the coated drum was dried at 100° C. for 30 minutes to obtain a photosensitive material layer having a thickness of 12 $\mu$m after drying.

PREPARATION OF DEVELOPER

| | |
|---|---|
| Pliolite ACL (styrene-acrylic copolymer supplied by Goodyear Co.) | 40 parts by weight |
| Viscol 550P (low-molecular-weight polypropylene supplied by Sanyo Kasei K.K.) | 5 parts by weight |
| Tetsuguro B6 (triiron tetroxide supplied by Toyo Shikiso K.K.) | 55 parts by weight |

The above components were mixed and the mixture was melt-kneaded by a mill comprising three hot rolls, and the kneaded mixture was cooled and finely divided by a jet mill. Particles having a particle size of 5 to 15 μm were collected by a pneumatic classifier supplied by Alpine Co.

EXPERIMENT

A commercially available electrophotographic copying machine (Model DC-111 supplied by Mita Industrial Co.) was remodeled so that the bias voltage of the developing zone could be adjusted and the polarity of the voltage supplied to the transfer charger could be changed. The above-mentioned photosensitive material drum and the developer were attached to the remodeled copying machine.

The surface voltage of the photosensitive material drum by main charging was adjusted to +600 V, and the development bias voltage was changed from +600 V to −600 V by intervals of 50 V and a copy having a solid black portion and a white portion was copied at respective development bias voltages. The image density was measured by using a densitometer (Model TD-6D supplied by Tokyo Denshoku K.K.). Results obtained when the polarity of transfer charging was positive and negative are shown in FIGS. 4 and 5, respectively.

Ordinarily, if the image density of the solid black portion is higher than 0.5 and the image density of the white portion is lower than 0.2, obtained prints can be practically used.

EXAMPLE 1

In the above-mentioned experimental copying machine, the set surface voltage was adjusted to +600 V, the development bias voltage was adjusted to +150 V and the polarity of transfer charging was set at a positive level, and an ordinary original, that is, a white paper having black letters, was copied. Copies having a clear image were obtained.

Then, the development bias voltage was changed to +400 V and the polarity of transfer charging was changed to a negative polarity, and the same original as described above was copied. Copies having a clear reversed image were obtained.

EXAMPLE 2

Reproduction was carried out in the same manner as described in Example 1 by using the reversed image copy obtained in Example 1 as the original. A copy having a reversed image of the first original and a copy having the same image as that of the first original were obtained.

EXAMPLE 3

Reproduction was carried out in the same manner as described in Example 1 except that the development bias voltage was set at +300 V, positive and reversed images could be easily obtained only by changing the polarity of transfer charging, though the image density of the black portion was slightly reduced.

We claim:

1. An electrophotographic process which comprises developing an electrophotographic light-sensitive layer having an electrostatic charge image of a certain polarity with a one-component type magnetic developer where positive and negative frictional charge polarities are mingled, under a development bias voltage capable of developing the electrostatic charge image, the background or both, wherein the development bias voltage is 0 to 30% of the set surface voltage Vo of the light-sensitive layer with the same polarity as that of the set surface voltage Vo to form a positive image on a transfer sheet, the development bias voltage, is 50 to 150% of the set surface voltage Vo of the light-sensitive layer with the same polarity as that of the set surface voltage Vo to form a negative image on the transfer sheet, or the development bias voltage is 30 to 50% of the set surface voltage Vo of the light-sensitive layer with the same polarity as that of the set surface voltage Vo to form either a positive or negative image on the transfer sheet, and bringing the light-sensitive layer having a developer layer formed thereon into contact with the transfer sheet under a transfer charge of the same polarity as that of the electrostatic charge image when a positive image is formed or under a transfer charge of a polarity reverse to that of the electrostatic charge image when a negative image is formed, to form an image on the transfer sheet.

2. An electrophotographic process according to claim 1, wherein the one-component type magnetic developer is one obtained by pulverizing a kneaded composition comprising 40 to 75 parts by weight of a powder of a magnetic material dispersed in 100 parts by weight of an electrically insulating resin binder, if necessary followed by sieving, to form particles having a particle size of 5 to 30 μm.

3. An electrophotographic process according to claim 2, wherein the developer comprises 50 to 60 parts by weight of a magnetic material powder dispersed in 100 parts by weight of an electrically insulating resin binder.

4. An electrophotographic processs according to claim 1 wherein the transfer image density of the positive image is highest at a low bias voltage and the transfer image density of the negative image is highest at a high bias voltage.

5. An electrophotographic process according to claim 1 wherein a positive image or a negative image is alternately obtainable by selecting a negative or a positive transfer charge polarity at an intermediate bias voltage of about 300 V.

6. An electrophotographic process according to claim 1, wherein the magnetic material of the one-component type magnetic developer is a powder having a particle size of 0.05 to 5 μm and selected from the group consisting of triiron tetroxide, diiron trioxide, zinc iron oxide, yttrium iron oxide, cadmium iron oxide, gadolinium iron oxide, copper iron oxide, lead iron oxide, nickel iron oxide, neodymium iron oxide, barium iron oxide, magnesium iron oxide, manganese iron oxide, lanthanum iron oxide, iron powder, cobalt powder and nickel powder.

* * * * *